US010458739B2

(12) United States Patent
Smith

(10) Patent No.: US 10,458,739 B2
(45) Date of Patent: Oct. 29, 2019

(54) SILENCER BAFFLE ASSEMBLY

(71) Applicant: RA Brands, L.L.C., Madison, NC (US)

(72) Inventor: Michael Leighton Smith, Alpharetta, GA (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 15/962,858

(22) Filed: Apr. 25, 2018

(65) Prior Publication Data

US 2018/0313624 A1 Nov. 1, 2018

Related U.S. Application Data

(60) Provisional application No. 62/490,209, filed on Apr. 26, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS

| | | | | |
|---|---|---|---|---|
| 959,400 | A | 5/1910 | Stinson | |
| 1,259,251 | A * | 3/1918 | Love | F41A 21/30 181/223 |
| 2,315,207 | A | 3/1943 | Janecek et al. | |
| 2,503,491 | A | 4/1950 | Janz | |
| 2,792,760 | A | 5/1957 | Hammer | |
| 3,667,570 | A | 6/1972 | WerBell, III | |
| 3,786,895 | A | 1/1974 | Perrine | |
| 4,291,610 | A * | 9/1981 | Waiser | F41A 21/30 89/14.4 |
| 4,384,507 | A | 5/1983 | Finn | |
| 4,510,843 | A | 4/1985 | Rabatin | |
| 4,576,083 | A | 3/1986 | Seberger, Jr. | |
| 4,588,043 | A | 5/1986 | Finn | |
| 4,907,488 | A | 3/1990 | Seberger | |
| 4,974,489 | A | 12/1990 | Fishbaugh | |
| 5,029,512 | A | 7/1991 | Latka | |
| 5,679,916 | A * | 10/1997 | Weichert | F41A 21/30 181/223 |
| 6,374,718 | B1 | 4/2002 | Rescigno et al. | |

(Continued)

FOREIGN PATENT DOCUMENTS

| | | |
|---|---|---|
| GB | 966934 | 8/1964 |
| GB | 2511387 B | 6/2015 |
| WO | WO2009139803 A2 | 11/2009 |

OTHER PUBLICATIONS

Author unknown; "What is wrong with this K-Baffle design?"; begun Sep. 10, 2015; Silencer Talk; pp. 1-4. (Year: 2015).*

*Primary Examiner* — Bret Hayes
(74) *Attorney, Agent, or Firm* — Womble Bond Dickinson (US) LLP

(57) ABSTRACT

A silencer can include an aligned baffle assembly with a series of baffles that are configured and/or adapted to be readily and substantially completely aligned to facilitate construction and assembly of the baffles in a desired rotational orientation so as to define a baffle core for the silencer, while also facilitating the quick and easy removal and disassembly of the baffle core from the silencer body for cleaning and/or maintenance thereof.

11 Claims, 5 Drawing Sheets

(56) References Cited

U.S. PATENT DOCUMENTS 6,425,310 B1* 7/2002 Champion ..... F41A 21/30 89/14.3
6,575,074 B1 6/2003 Gaddini
6,796,214 B2 9/2004 Hausken et al.
6,796,403 B1 9/2004 Laughlin
6,848,538 B2 2/2005 Shafer
7,073,426 B1 7/2006 White
7,237,467 B1 7/2007 Melton
7,308,967 B1 12/2007 Hoel
7,412,917 B2 8/2008 Vais
7,516,690 B2 4/2009 McClellan
7,600,606 B2 10/2009 Brittingham
7,610,992 B2 11/2009 Brittingham
7,789,008 B2 9/2010 Petersen
7,832,323 B1 11/2010 Davies
7,856,914 B2 12/2010 Shults et al.
7,874,238 B2 1/2011 Silvers
7,905,171 B1 3/2011 Brittingham
7,931,118 B1 4/2011 Cronhelm
7,987,944 B1 8/2011 Brittingham et al.
8,096,222 B2 1/2012 Silvers
8,100,224 B1 1/2012 Olson
8,104,570 B2 1/2012 Miller et al.
D657,012 S 4/2012 Woodell
8,162,100 B2 4/2012 Shults et al.
8,167,084 B1 5/2012 Moore
8,171,840 B2 5/2012 Kline
8,292,025 B1 10/2012 Woodell et al.
8,307,946 B1 11/2012 Johnston
8,424,635 B1 4/2013 Klawunn
8,453,789 B1 6/2013 Honigmann et al.
8,459,406 B1 6/2013 Dueck
8,474,361 B2 7/2013 Brittingham
8,490,535 B1 7/2013 Moore et al.
8,505,431 B2 8/2013 Hines
8,505,680 B2 8/2013 Dueck
8,511,425 B2 8/2013 Larue
8,516,941 B1 8/2013 Oliver
8,528,691 B1 9/2013 Carmichael et al.
8,567,556 B2 10/2013 Dueck et al.
8,579,075 B2 11/2013 Brittingham et al.
8,584,794 B2 11/2013 Dueck
8,714,301 B2 5/2014 Shults
8,739,922 B2 6/2014 Wirth et al.
8,770,084 B2 7/2014 Young
8,807,272 B2 8/2014 Bladen
8,820,473 B1 9/2014 White
8,833,512 B2 9/2014 Smith et al.
8,910,745 B2 12/2014 Latka
8,910,746 B1 12/2014 McKenzie
8,950,310 B2 2/2015 Storrs et al.
8,973,481 B2 3/2015 Dueck et al.
8,991,550 B2 3/2015 Coley
8,991,552 B2 3/2015 Latka
9,038,770 B1 5/2015 Morrison
9,038,771 B1 5/2015 Mueller
9,046,316 B1 6/2015 Young
9,086,248 B2 7/2015 Young et al.
9,091,502 B1 7/2015 Morrison
9,097,482 B1 8/2015 Holden et al.
9,102,010 B2 8/2015 Wilson
9,103,618 B2 8/2015 Daniel et al.
9,115,949 B1 8/2015 Morrison
9,115,950 B2 8/2015 Bethlenfalvy
9,121,656 B1 9/2015 McKenzie
9,175,920 B2 11/2015 Moore
9,207,033 B2 12/2015 Vais
9,328,984 B2 5/2016 Shults et al.
9,347,727 B1 5/2016 Cler
9,506,710 B2 11/2016 Smith
9,658,019 B2 5/2017 Smith
9,746,267 B2 8/2017 Smith
2006/0123983 A1 6/2006 Vais
2009/0139795 A1 6/2009 Brittingham
2010/0218671 A1 9/2010 Mayberry et al.
2011/0132683 A1 6/2011 Miller et al.
2012/0048644 A1 3/2012 Kline et al.
2012/0145478 A1 6/2012 Brittingham
2012/0152093 A1 6/2012 Koumbis
2012/0152649 A1 6/2012 Larue
2012/0167749 A1 7/2012 Young
2012/0180624 A1 7/2012 Troy et al.
2012/0255807 A1 10/2012 Pieratti
2013/0175113 A1 7/2013 Hines
2013/0312592 A1 11/2013 Storrs et al.
2013/0319790 A1 12/2013 Bladen
2014/0076658 A1 3/2014 Smith, II et al.
2014/0157640 A1 6/2014 Whelan
2014/0190345 A1 7/2014 Daniel et al.
2014/0224575 A1 8/2014 Latka
2014/0237881 A1 8/2014 Mack
2014/0262604 A1 9/2014 Proske
2014/0299405 A1 10/2014 Miller et al.
2014/0318887 A1 10/2014 Latka
2014/0374189 A1 12/2014 Young et al.
2015/0226506 A1 8/2015 Shults et al.
2015/0260472 A1 9/2015 Smith
2015/0260473 A1 9/2015 Barney
2015/0267986 A1 9/2015 Sellars
2015/0276340 A1 10/2015 Vais
2015/0285575 A1 10/2015 Sclafani
2015/0292829 A1 10/2015 Pietila
2015/0323276 A1 11/2015 Myers et al.
2015/0338183 A1 11/2015 Salvador
2016/0018179 A1* 1/2016 Morris ..... F41A 21/30 181/223
2016/0061551 A1 3/2016 Petersen
2016/0084602 A1 3/2016 Smith
2016/0109205 A1* 4/2016 Coppinger ..... F41A 21/30 89/14.4
2016/0209151 A1 7/2016 Smith
2017/0160034 A1* 6/2017 Parker ..... F41A 21/30
2017/0160035 A1* 6/2017 Piemme ..... F41A 21/30
2017/0321984 A1* 11/2017 Palu ..... F41A 21/34
2018/0023914 A1* 1/2018 Latka ..... F41A 21/30 89/14.4

* cited by examiner

SILENCER BAFFLE ASSEMBLY

CROSS REFERENCE TO RELATED APPLICATIONS

The present application claims the benefit of previously filed, U.S. Provisional Patent Application No. 62/490,209, filed Apr. 26, 2017.

INCORPORATION BY REFERENCE

The specification and drawings of U.S. Provisional Patent Application No. 62/490,209, filed Apr. 26, 2017, are specifically incorporated herein by reference as if set forth in their entirety.

TECHNICAL FIELD

The present disclosure generally relates to silencers or noise suppressors for firearms, and in particular to a stackable baffle assembly for silencers or noise suppressors that facilitates alignment of the baffles during assembly to form a baffle core for a silencer or noise suppressor, while further enabling easier disassembly of the baffle core from the silencer or noise suppressor.

BACKGROUND

Noise suppressors or silencers for firearms, including rifles and handguns, have been used for reducing the sound signature and muzzle flash of a host firearm. For example, the sound or report generated upon firing the host firearm can provide an audible cue to the location of a shooter, and further can cause significant harm to the shooter's hearing, while muzzle flashes can be harmful to the user's night vision and likewise can provide a visual cue as to their location. Silencers or noise suppressors therefore have been developed to substantially reduce these concerns. Most silencers typically include a core, such as a monocore, i.e., a monolithic or solid piece of material with a series of cuts and/or holes defining baffles and passages for creation of turbulence in propulsion gases passing through the silencer or suppressor, or alternatively, a stackable baffle core having a series of stacked baffles. Such stacked baffle cores have been found to be particularly effective with the use of certain calibers, for example, .22 caliber firearms.

In assembling a stacked baffle core for silencers or suppressors, it generally is important to make sure the silencer baffles are each aligned in a desired or necessary rotational orientation. To this end, some prior baffle designs have included tabs and notches for alignment. A problem that has been found with such designs, however, is that the notches typically must be machined with a tolerance or clearance that allows for easy engagement with a corresponding tab, but such clearances also provide a pathway for carbon, unburned powder and other fouling elements carried with propellant gases to escape and enter the gap or clearance between the spacer elements and/or baffles and the inner diameter of the silencer body. This buildup of carbon and other materials must be cleaned frequently to ensure proper operation of the silencer or suppressor, but the buildup of such materials also becomes a substantial impediment to the removal of the baffles and spacers from the silencer tube or body for cleaning and/or routine maintenance, making it difficult to disassemble and disconnect the baffles and spacers from the silencer tube as needed.

Accordingly, it can be seen that a need exists for a silencer baffle assembly that addresses the foregoing and other related and unrelated problems in the art.

SUMMARY

Briefly described, the present disclosure generally relates to the provision of a silencer or noise suppressor for use with a host firearm, and which includes a baffle assembly having a series of baffles that are configured and/or adapted to be readily and substantially completely aligned to facilitate construction and assembly of the baffles in a desired rotational orientation so as to define a baffle core for the silencer, while also facilitating the quick and easy removal and disassembly of the baffle core from the silencer body for cleaning and/or maintenance. The silencer generally can include a substantially tubular body with an inner wall defining an interior chamber or volume within the body of the silencer and in which the baffle assembly is received. The silencer further can include a first or forward end and a second or rearward end, with a connector, such as a threaded connection or other locking connector, generally being provided at the rear end of the silencer body for connection of the silencer to the host firearm.

The baffle assembly will include a series of baffle elements that are adapted to be arranged and/or coupled together aligned in stacked series to form a baffle core with a central passage defined therethrough and through which a projectile fired by the host firearm will pass. In one example embodiment, the baffle elements can include a series of "K baffles," including shielded K baffles, although other types or configurations of the baffles also can be used. Each of the baffle elements generally will include a body that can include a baffle and a spacer. In some embodiments, the spacers can be integrally formed with the baffles or can be provided as separate spacers mounted between successive baffles. The baffle elements further include a series of alignment features configured to enable the baffle elements to be substantially easily and accurately aligned in series with successive baffle elements being arranged in a desired rotational orientation and mounted together in a substantially sealed arrangement that impedes the escape of carbon, unburned powder and other elements of combustion that can foul or create an obstructive buildup between the baffle core and the interior side wall of the silencer body.

According to an aspect of the present disclosure, the alignment features of the baffle elements of the baffle assembly can include at least one alignment notch or recessed area located along a forward end of the baffle, for example being formed or defined along a substantially forward facing edge of a rim of the baffle. A corresponding alignment tab or projection further can be located along an interior portion of the spacer of each baffle element, located interiorly of the open, rearward end of the spacer. The alignment notches and corresponding tabs generally will be configured to matingly engage or fit together, and further can be formed with beveling or sloped or angled surfaces to facilitate the guidance and receipt of each tab within a corresponding alignment notch. As a result, each baffle element can be substantially quickly and easily located, aligned and/or connected in series, and with the point of connection between the alignment features of successive baffle elements being located within the area protected by the tubular spacer bodies of the stacked baffle elements. This helps substantially block or retard the passage or escape of combustion gases and fouling materials from the confines of the baffle core and into the clearance or space between the baffle core and the inner wall of the silencer body. By blocking the escape of such materials, this clearance or space is maintained substantially clear of obstructive buildup of carbon, powder, etc., so as to enable the baffle core to be quickly and easily removed and disassembled from the silencer body.

Various objects, features and advantages of the present disclosure will become apparent to those skilled in the art upon a review of the following detailed description, when taken in conjunction with the accompanying drawings.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure. Corresponding parts are designated by corresponding reference numbers throughout the drawings.

Figure 1:
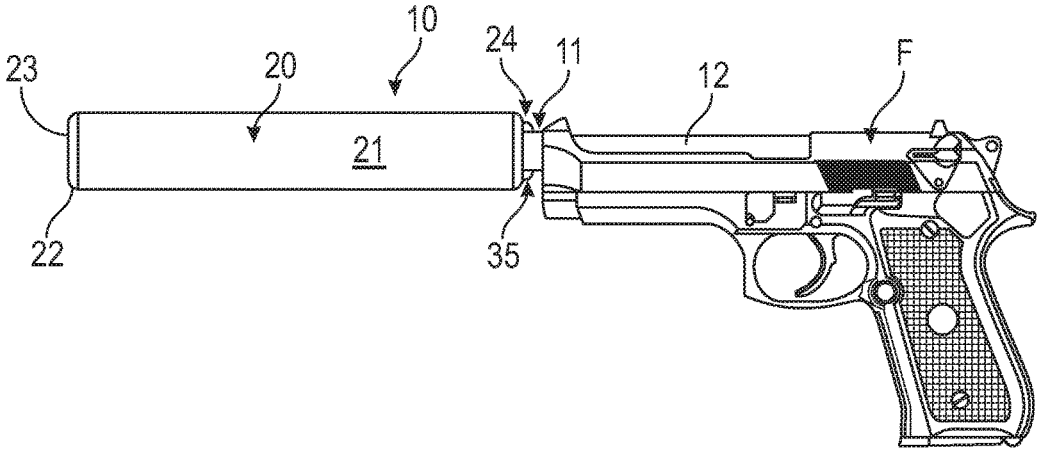
FIG. 1 is a side elevational view generally illustrating an example silencer mounted to a firearm.

The embodiments of the present disclosure and the various features thereof are explained below in detail with reference to non-limiting embodiments and examples that are described and/or illustrated in the accompanying drawings. It should be noted that various features illustrated in the drawings are not necessarily drawn to scale, and that features of one embodiment may be employed with other embodiments as the skilled artisan would recognize, even if not explicitly stated herein. Those skilled in the art will thus appreciate and understand that, according to common practice, the dimensions of various features and elements of the drawings may be expanded or reduced to more clearly illustrate the embodiments of the present disclosure described herein. In addition, descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION

Referring now to the drawings, in which like numerals indicate like parts throughout the several views, FIG. 1 generally illustrates a silencer 10 mounted to the muzzle end 11 of the barrel 12 of a host firearm F. While the firearm illustrated herein is shown as a handgun, it will be understood that silencers or suppressors for use with various other types of firearms, including rifles and other handguns, also can incorporate a baffle assembly 15 (FIG. 2) constructed in accordance with one or more embodiments of the present disclosure. As further generally illustrated in FIGS. 1 and 2, the silencer 10 generally will include a body 20, which can be formed as a substantially cylindrical tube, as illustrated, or can be formed with other configurations, such as substantially square or rectangular. The silencer body 20 additionally includes an exterior wall 21, a first, forward or distal end 22, at which an end cap 23 can be mounted or provided, and a second, rearward or proximal end 24 at which the silencer can be mounted to the muzzle end of the firearm barrel, such as indicated in FIG. 1.

Figure 2:
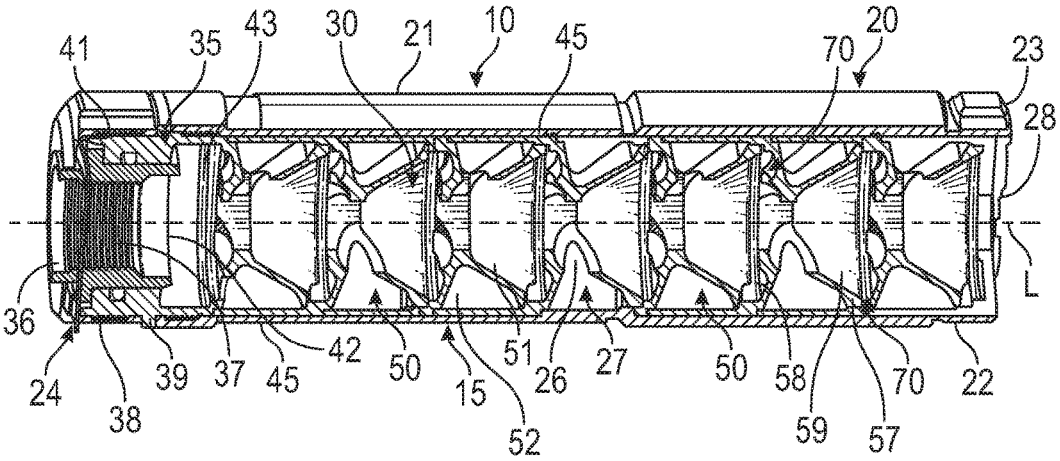
FIG. 2 is cross-sectional view of a silencer incorporating a baffle assembly according to one embodiment of the present disclosure.
Figure 3A:
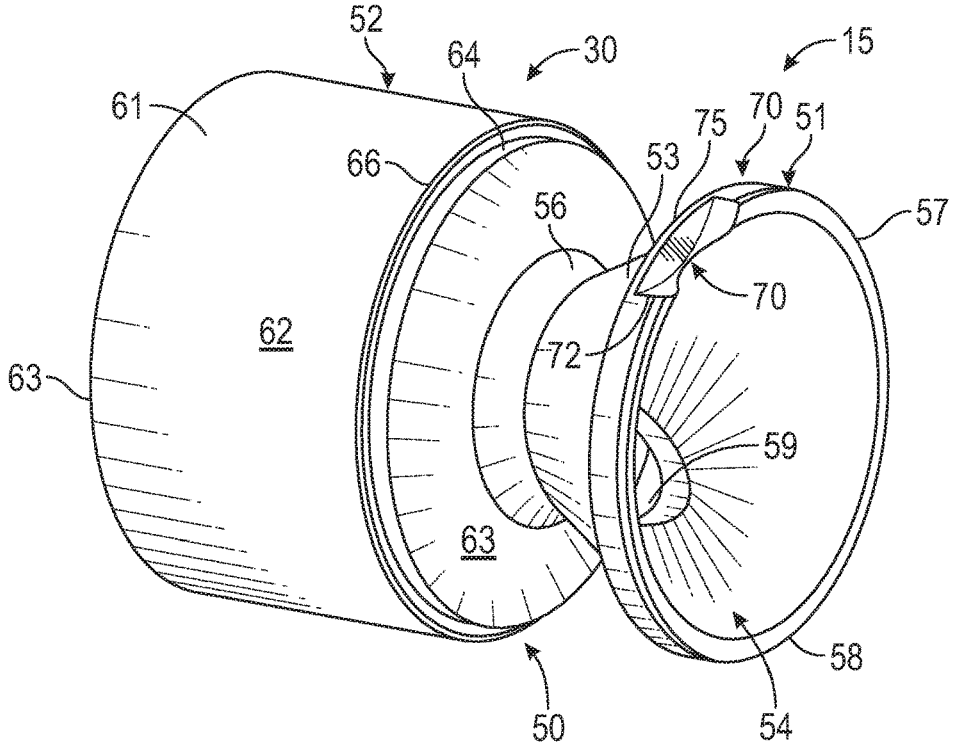
FIGS. 3A and 3B are perspective views of baffle elements including alignment features in accordance with the principles of the present disclosure.
Figure 3B:
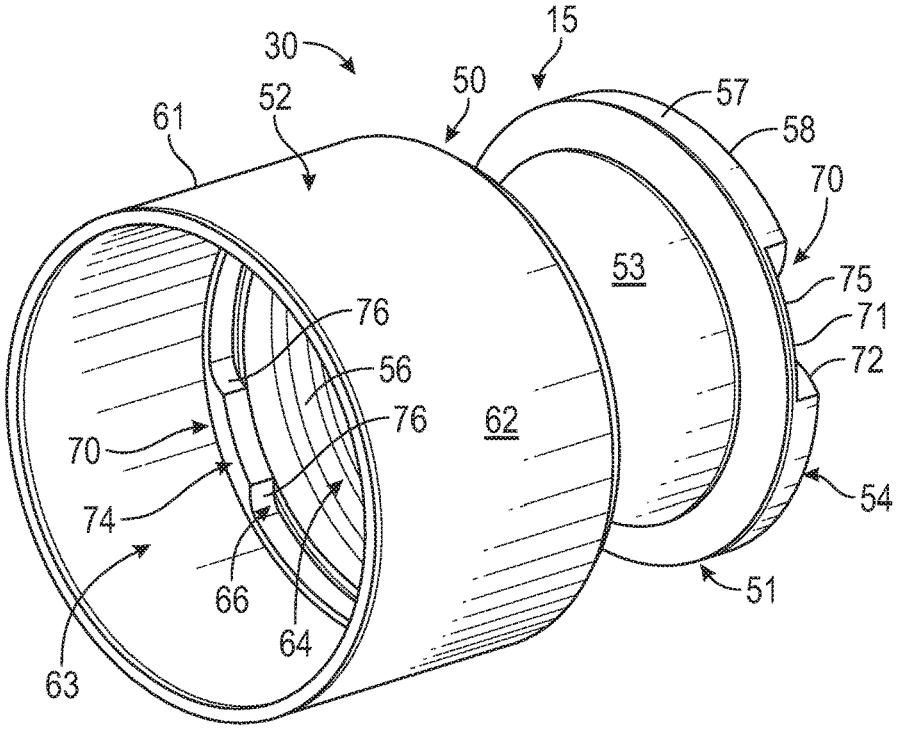

As shown in FIG. 2, the silencer body also will include an interior side wall 26 that defines an interior chamber or volume 27 in which the baffle assembly 15 is received. The baffle assembly 15 generally will include a series of baffle elements 30 stacked or coupled together in aligned series to form a stacked baffle core 28 defining a body 21, and the baffle elements 30 are assembled with a desired rotational orientation. A longitudinally extending projectile passage 31 is defined through the silencer body and through the aligned baffle elements 30 of the baffle assembly, generally extending along a longitudinal axis L as indicated in FIG. 2. The projectile passage extends from the rearward or proximal end 24 of the silencer body, through each of the baffle elements of the baffle assembly and through a projectile opening 33 defined in the front end cap 23 of the silencer body to enable the projectile fired by the firearm to pass through the silencer.

As additionally illustrated in FIG. 2, a connector 35 also can be provided or located at the rearward or proximal end 24 of the silencer body. In one embodiment, the connector 35 can include a threaded connector that includes a first portion 36 having a series of helical threads 37 formed along an interior surface thereof. The threads 37 of the connector 35 can engage and couple to corresponding threads formed about the muzzle end of the firearm barrel for releasably coupling or mounting the silencer to its host firearm, as indicated in FIG. 1. Alternatively, the connector 35 (FIG. 2) can include other types of releasable connectors, such as various types of locking or biased connectors as will be generally understood by those skilled in the art. In addition, the connector 35 can be mounted within the silencer body adjacent the rearward portion thereof, such as by a threaded or other, similar connection, including threads 38 defined about the exterior wall 39 of the connector 35, which can engage corresponding threads 41 formed along the interior side wall of the silencer body. A forward end portion 42 of the connector can be configured or sized so as to further receive a proximal or first end 43 of the baffle assembly 15 in a substantially seated, secure arrangement, and with the baffle assembly 15 extending longitudinally through the interior chamber or volume 27 of the silencer body. As further indicated in FIG. 2, a clearance or spacing 45 further can be provided between the body portion 29 of the baffle assembly 15/core and the interior side wall 26 of the silencer body.

Examples of the baffle elements 30 for forming the baffle assembly 15 are generally illustrated in FIGS. 3A-7B. Each of the baffle elements 30 generally will include a body 50 comprising a first portion or baffle 51 and a second portion or spacer 52. The baffles 51, for example, can include "K baffles," or shielded baffles, each having a conical or substantially conical profile including a rearward, tapering body section 53 that slopes/tapers inwardly from a forward end or portion 54 adjacent the spacer 52, toward a rear or reduced diameter end 56. A rim or collar 57 generally is formed about the forward portion 54 of the baffle, the rim 57 shown as having an expanded diameter, in one embodiment, terminating at a forward facing edge 58. As further indicated in FIGS. 3A, 4, and 5C-7B, one or more ports or outlets 59 can be formed along the conical portion or body section 53, for example adjacent the rearward end 56 of the baffle. The port(s) can enable the flow of propulsion or combustion gases away from the projectile passage 31 defined through each of the baffles of the baffle assembly to facilitate creation of turbulence within this gas flow. In addition, other types or configurations of baffles, including "M" baffles or "omega" type baffles also can be used.

Figure 4:
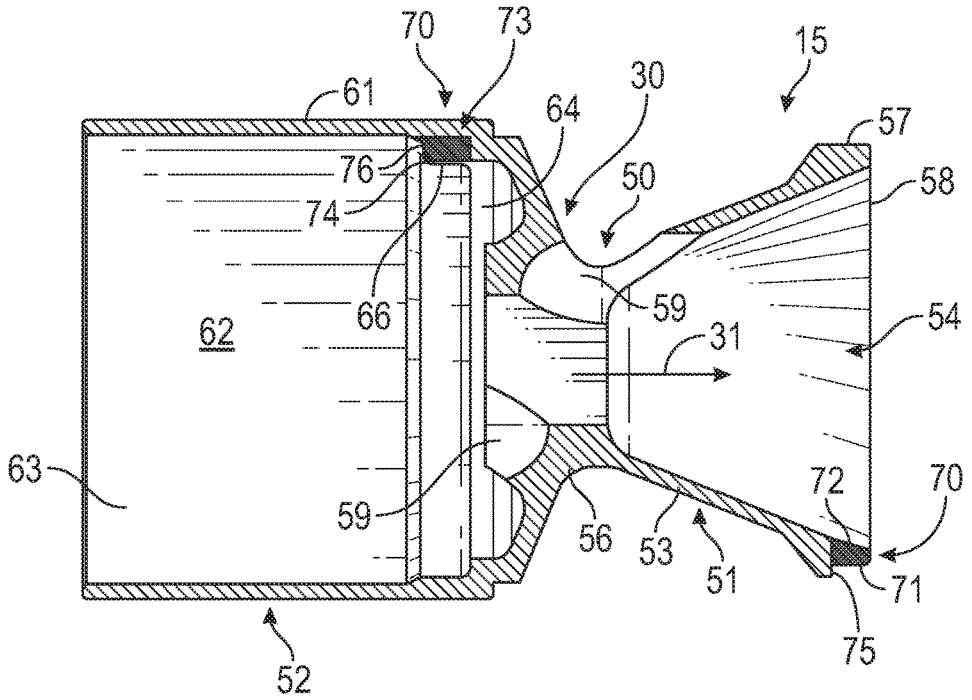
FIG. 4 is a cross-sectional view of a baffle element such as shown in FIGS. 3A and 3B.
Figure 5A:
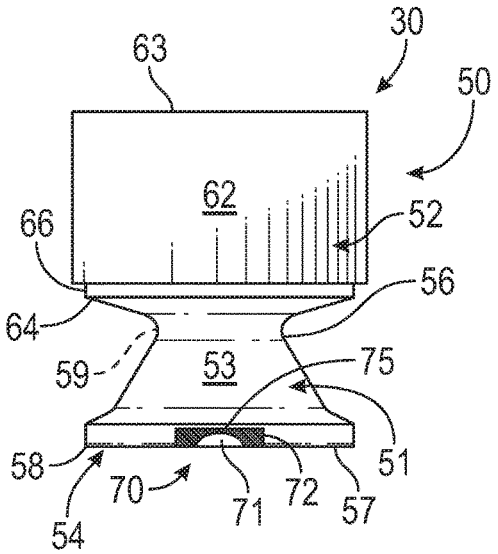
FIGS. 5A-5C are side elevational views showing different orientations or sides of the baffle elements of FIGS. 3A-4.
Figure 5B:
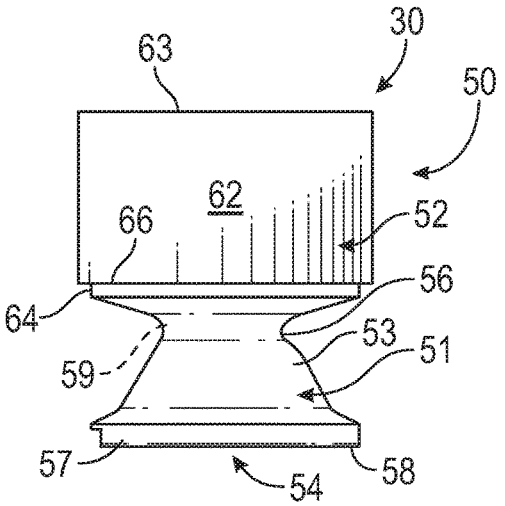
Figure 5C:
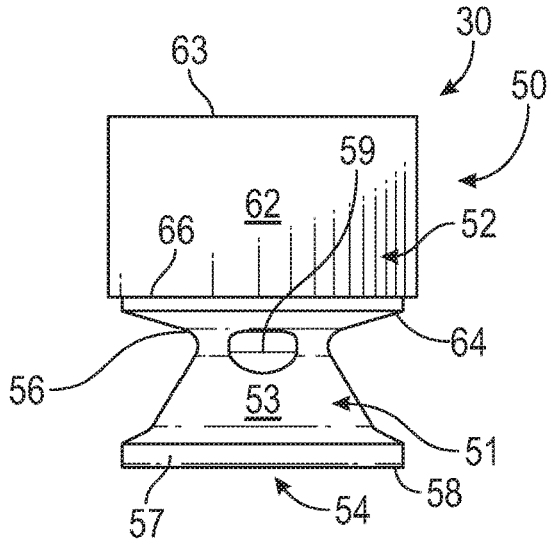
Figure 6A:
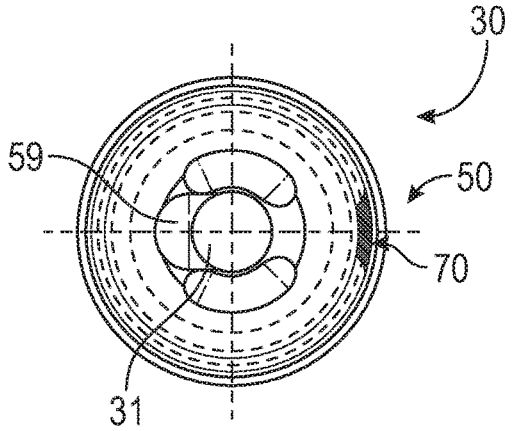
FIGS. 6A and 6B are end elevational views of the baffle elements of FIGS. 3A-5C.
Figure 6B:
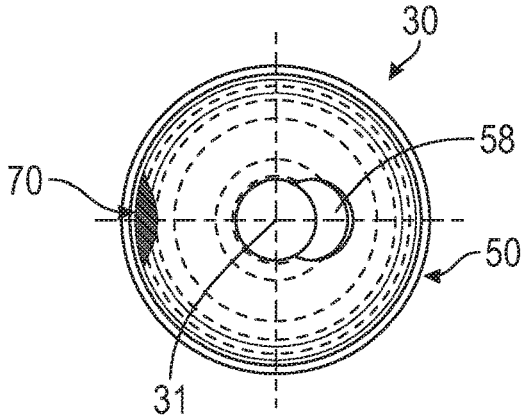
Figure 7A:
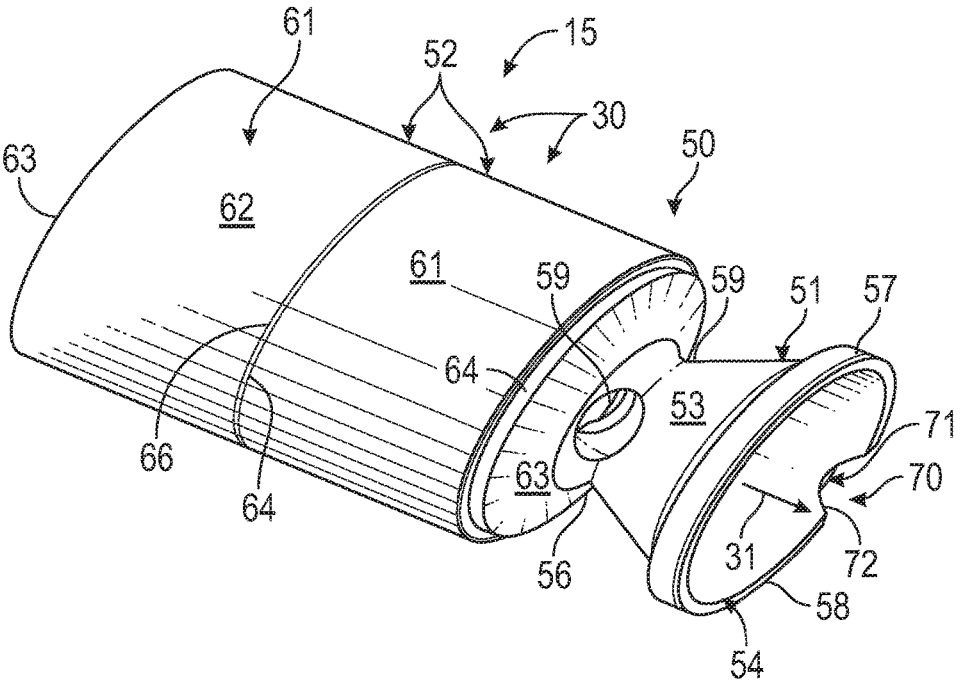
FIG. 7A is a perspective view illustrating a series of baffle elements connected in series.
Figure 7B:
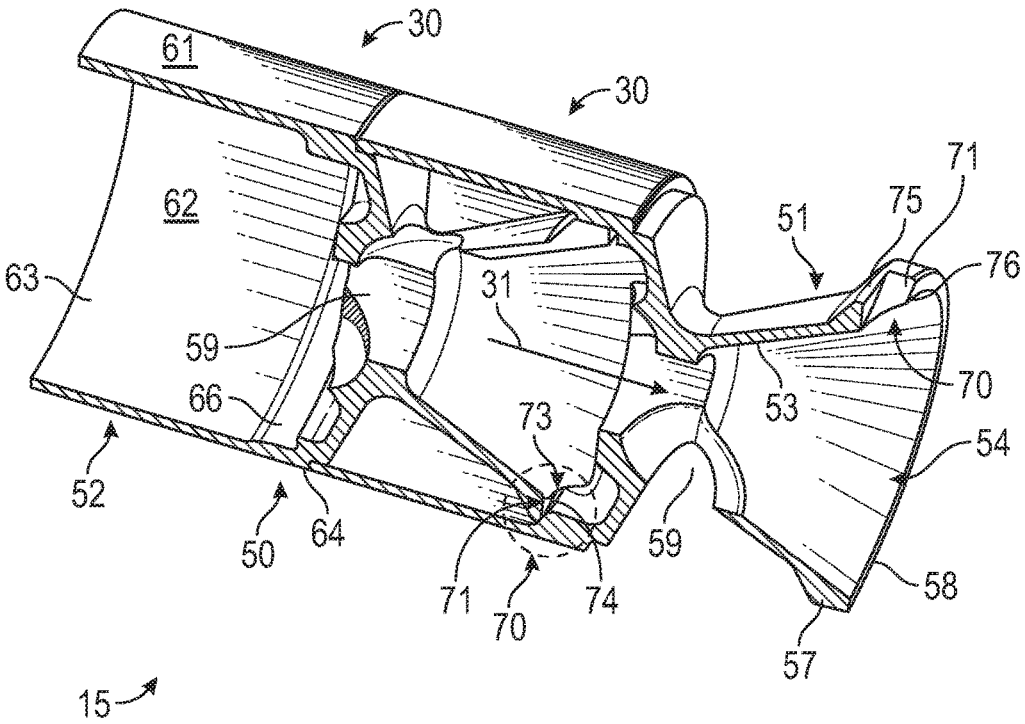
FIG. 7B is a cross-sectional view of the connected baffle elements of FIG. 7A.

As further indicated in FIGS. 3A-4 and 5A-5C, the spacers 52 of each of the baffle elements generally will extend rearwardly from the rearward end of each baffle, and can have a substantially cylindrically shaped body 61 in which the baffle 51 of another baffle element 30 is received, such as shown in FIGS. 2 and 7B. As indicated in FIGS. 3B, 4 and 7B, the spacers of each baffle element further can include a generally cylindrical side wall or shroud 62 defining an open-ended recess or chamber 63 in which the baffle of an adjacent baffle element is received so as to provide a shielded or shrouded mounting for the baffles of a successive or adjacent baffle element coupled to/stacked therewith. The chamber 63 further can include a recessed forward portion 64 having a rim 66 against which the rim 57 of the baffle 51 received therein can be seated in abutting contact and/or substantially sealed engagement, as indicated in FIG. 7B.

Each of the baffle elements additionally will include alignment features 70 that are adapted or configured to facilitate the quick and substantially accurate alignment of successive baffle elements 30 to form the aligned baffle assembly/core 28 of the silencer, with the baffle elements being located in a desired orientation or alignment with respect to the projectile passage and defined therethrough. In one embodiment, as generally illustrated in FIGS. 3A-3B and 7A-7B, the alignment feature 70 will include a notch or recess 71 formed within the rim 57 of the baffle 51 of each baffle element 30, located along the forward facing edge 58. The notch or recess 71 can have a substantially square, rectangular, or a generally tapered profile, for example having a substantially V- or U-shaped profile, although other configurations also can be provided. The notch 71 also can include beveled or sloped side walls 72 to help enable substantial self-locating and ease of guidance/fit of a corresponding alignment tab 73 formed within the interior chamber or recess of the spacer 52 in which the baffle 51 is received, and further can include a back wall 75, formed in the rim 57, against which the alignment tab is engaged.

Each alignment tab 73 also generally can have a substantially matched or mating profile corresponding to the alignment notches of the baffles; for example including a substantially square or trapezoidal shaped projection or body 74, which further can have beveled or tapering sides 76 configured to substantially help guide or self-locate the alignment tab within the alignment recess of the baffle received therein, such as illustrated in FIG. 7B. The alignment notches and tabs of the baffle elements can be arranged at offset locations or positions, for example being spaced approximately 180° apart in order to provide a desired alignment/orientation of each successive baffle element, i.e., to orient or direct its gas port in a desired direction. However, while an offset of approximately 180° is illustrated in the figures, it will be understood that various other offsets or orientations of the alignment features of each of the baffle elements also can be provided, including having the baffle elements in a substantially longitudinally aligned arrangement.

As a result, as generally illustrated in FIGS. 2 and 7A-7B, the baffle elements 30 of the baffle assembly 15 can be quickly and easily assembled into a stacked, aligned baffle core for a silencer, with the alignment features of each of the baffle elements engaging and helping to substantially locate, guide and/or self-align each of the baffles in a desired rotational orientation along the longitudinal axis L, such as illustrated in FIG. 2. As indicated further in FIGS. 2 and 7B, the engagement of the alignment tabs within their corresponding alignment recesses within an area protected by the shroud or shielding wall of the tubular spacer of each baffle element and bounded by a back wall or further portion 75 of the alignment recess 71 of each baffle 51, in addition to helping to facilitate coupling of the series of baffle elements in a substantially aligned, stacked arrangement, further enables or provides an effectively sealed coupling arrangement between adjacent baffle elements that substantially closes off or blocks unwanted passage of carbon, unburned powder and other byproducts of combustion carried with the combustion/propellant gases driving the projectile through the silencer. Thus, the escape of these fouling materials outside the confines of the body of the baffle assembly is substantially blocked or obstructed. By substantially obstructing or blocking the passage of such fouling materials or byproducts of combustion into the confines or clearance 45 (FIG. 2) between the interior side wall of the silencer body and the body of the baffle assembly, the baffle assembly 15 can be substantially easily and quickly dislocated/disengaged from the silencer body and disassembled for cleaning, maintenance and/or replacement as needed.

Still further, the arrangement of the baffle elements of the baffle assembly 15 according to the principles of the present disclosure further can help facilitate formation and/or use of various different silencer or suppressor designs, including the modular silencer designs. For example, the baffle elements can be arranged or constructed to form a series of baffle assemblies 15 or cores, as part of one or more silencer body sections or units, and then can be connected in series to each other as part of the interconnection of such multiple silencer body sections or units. Accordingly, modular and/or various length silencer assemblies can be quickly and easily formed.

The foregoing description of the disclosure illustrates and describes various exemplary embodiments. Various additions, modifications, changes, etc. could be made to the exemplary embodiment without departing from the spirit and scope of the claims. It is intended that all matter named in the above description or shown in the accompanying drawings shall be interpreted as illustrative and not in a limiting sense. Additionally, the disclosure shows and describes only select embodiments in the disclosure, but the disclosure is capable of use in various other combinations, modifications, and environments and is capable of changes or modifications within the scope of the invented concept as expressed herein, commensurate with the above teachings, and/or within the skill or knowledge of the relevant art. Furthermore, certain features and characteristics of each embodiment may be selectively interchanged and applied to other illustrated and non-illustrated embodiments of disclosure.

What is claimed is:

1. A silencer comprising:

a silencer body with an inner wall defining an interior chamber;

a connector located at a rearward end of the silencer body for connection of the silencer to a host firearm; and a baffle assembly received within the silencer body, the baffle assembly comprising a plurality of baffle elements received in aligned, stacked series along the interior chamber of the silencer body so as to define a baffle core for the silencer, wherein at least some of the baffle elements include an alignment tab and an alignment notch, and wherein the alignment tabs engage the alignment notches of adjacent baffle elements, wherein each of the baffle elements comprises a baffle, and a spacer located rearwardly of the baffle and having a body configured to receive the baffle of an adjacent baffle element therein, with successive stacked baffle elements being arranged in a desired rotational orientation and mounted together in a substantially sealed arrangement sufficient to substantially contain and impede escape of carbon, unburned powder, and other elements of combustion that will foul or create an obstructive buildup between the baffle core and an interior side wall of the silencer body, from the baffle core, wherein each of the alignment notches are located along a forward end of one of the baffles, and wherein each alignment tab is located along an interior portion of the spacer of each baffle element, such that a point of connection between the alignment tabs and alignment notches of successive baffle elements is located within an area substantially enclosed by the bodies of the spacers of the stacked baffle elements.

2. The silencer of claim 1, wherein each of the baffle elements further comprises an opening, wherein the openings of the baffle elements are aligned to define a projectile passage extending through the baffle core and through which a projectile fired by the host firearm can pass.

3. The silencer of claim 1, wherein the baffle elements comprise a series of K baffles.

4. The silencer of claim 1, wherein the alignment notch of at least one baffle element of the plurality of baffle elements is formed along a substantially forward facing edge of the baffle of the at least one baffle element, and is offset from the alignment tab defined in the spacer of the at least one baffle element.

5. The silencer of claim 4, wherein the alignment notch and alignment tab of the at least one baffle element are offset by approximately 90° to approximately 180°.

6. The silencer of claim 1, wherein one or more alignment notches and one or more corresponding tabs comprise beveling, sloped, or angled surfaces to facilitate the guidance and receipt of the one or more corresponding tabs within the one or more alignment notches, such that each baffle element can be located in aligned series to form the baffle core.

7. A silencer comprising:

an elongated silencer body; and a baffle core received within the silencer body, the baffle core comprising:

a series of baffle elements each including a baffle and a spacer; and a series of alignment features located along a forward end of the baffle and along an interior portion of the spacer of each baffle element, the alignment features of each baffle element configured to cooperatively engage with corresponding alignment features of successive baffle elements to facilitate a stacked engagement of the baffle elements in a desired rotational orientation and in a substantially sealed arrangement that impedes escape of carbon, unburned powder, and other elements of combustion that will foul or create an obstructive buildup between the baffle core and an interior side wall of the silencer body.

8. The silencer of claim 7, wherein the baffles and spacers of at least some of the baffle elements are integrally formed together.

9. The silencer of claim 7, wherein the alignment features comprise a recess defined along a rim portion of each baffle, and an alignment tab formed along the interior portion of each spacer, each alignment tab configured to matingly engage with the recess of the baffle of an adjacent baffle element stacked therein.

10. The silencer of claim 9, wherein the alignment tab of the spacer of at least one baffle element of the series of baffle elements is offset from the recess of the at least one baffle element by approximately 90° to approximately 180°.

11. The silencer of claim 7, wherein the alignment features comprise a recess formed along a rim portion of the baffle of each baffle element, and an alignment tab formed along the interior portion of the spacer of each baffle element, and wherein the recesses and alignment tabs each comprise beveling, sloped, and/or angled surfaces configured to guide receipt of the alignment tab of the spacer of each baffle element into mating engagement within a corresponding recess of the baffle of an adjacent baffle element received therein to facilitate locating, aligning, and coupling of the series of baffle elements in series to form the baffle core with a projectile path defined therethrough and with the baffle core being substantially sealed to contain carbon, unburned powder, and other elements of combustion therein.

* * * * *